US005449027A

United States Patent [19]

Mueller

[11] Patent Number: 5,449,027

[45] **Date of Patent: * Sep. 12, 1995**

[54] FITMENT APPARATUS AND METHOD TO PROVIDE BAG-IN-A-BOX SYSTEM

[75] Inventor: Alfred F. Mueller, Neshanic Station, N.J.

[73] Assignee: International Flavors & Fragrances Inc., New York, N.Y.

[ * ] Notice: The portion of the term of this patent subsequent to Dec. 20, 2011 has been disclaimed.

[21] Appl. No.: 214,495

[22] Filed: Mar. 18, 1994

Related U.S. Application Data

[63] Continuation-in-part of Ser. No. 84,075, Jun. 30, 1993, Pat. No. 5,373,872.

[51] Int. Cl.[6] ..... B65B 1/04; B65B 3/00

[52] U.S. Cl. ..... 141/10; 141/11; 141/48; 141/63; 141/85; 141/92; 141/314; 141/392; 81/3.4; 215/295

[58] Field of Search ..... 141/10, 11, 18, 21, 141/19, 47, 48, 63, 85, 91, 92, 313, 314, 392; 222/148, 541, 105; 81/3.07, 3.4; 7/151; 215/295, 296, 298, 302, 303, 253, 254; 422/26, 302

[56] References Cited

U.S. PATENT DOCUMENTS

| | | | |
|---|---|---|---|
| Re. 32,354 | 2/1987 | Savage | 222/81 |
| 3,894,381 | 7/1975 | Christine et al. | 53/128 |
| 4,105,139 | 8/1978 | Scholle | 222/105 |
| 4,331,266 | 5/1982 | Bond | 222/107 |
| 4,351,455 | 9/1982 | Bond | 222/153 |
| 4,362,255 | 12/1982 | Bond | 222/107 |
| 4,380,310 | 4/1983 | Schneiter et al. | 222/501 |
| 4,440,316 | 4/1984 | Christine | 222/83.5 |
| 4,445,550 | 5/1984 | Davis et al. | 141/329 |
| 4,458,734 | 7/1984 | Scholle et al. | 141/5 |
| 4,478,242 | 10/1984 | Bond | 137/383 |
| 4,601,410 | 7/1986 | Bond | 222/92 |
| 4,711,380 | 12/1987 | Ulm | 222/541 |
| 4,767,478 | 8/1988 | Christine | 156/69 |
| 4,796,788 | 1/1989 | Bond | 222/94 |
| 5,037,002 | 8/1991 | Tschanen | 222/105 |
| 5,129,212 | 7/1992 | Duffey et al. | 53/426 |

*Primary Examiner*—Henry J. Recla
*Assistant Examiner*—Steven O. Douglas
*Attorney, Agent, or Firm*—Arthur L. Liberman

[57] ABSTRACT

A fitment device is disclosed to be used with a "bag-in-a-box" packaging system. The fitment connects the bag with a valve system and optionally contains a removable diaphragm. The diaphragm is opened by operating a tool which separates and pulls out the diaphragm. A method of assembling the device with the entire system is also disclosed.

11 Claims, 6 Drawing Sheets

FIG.2
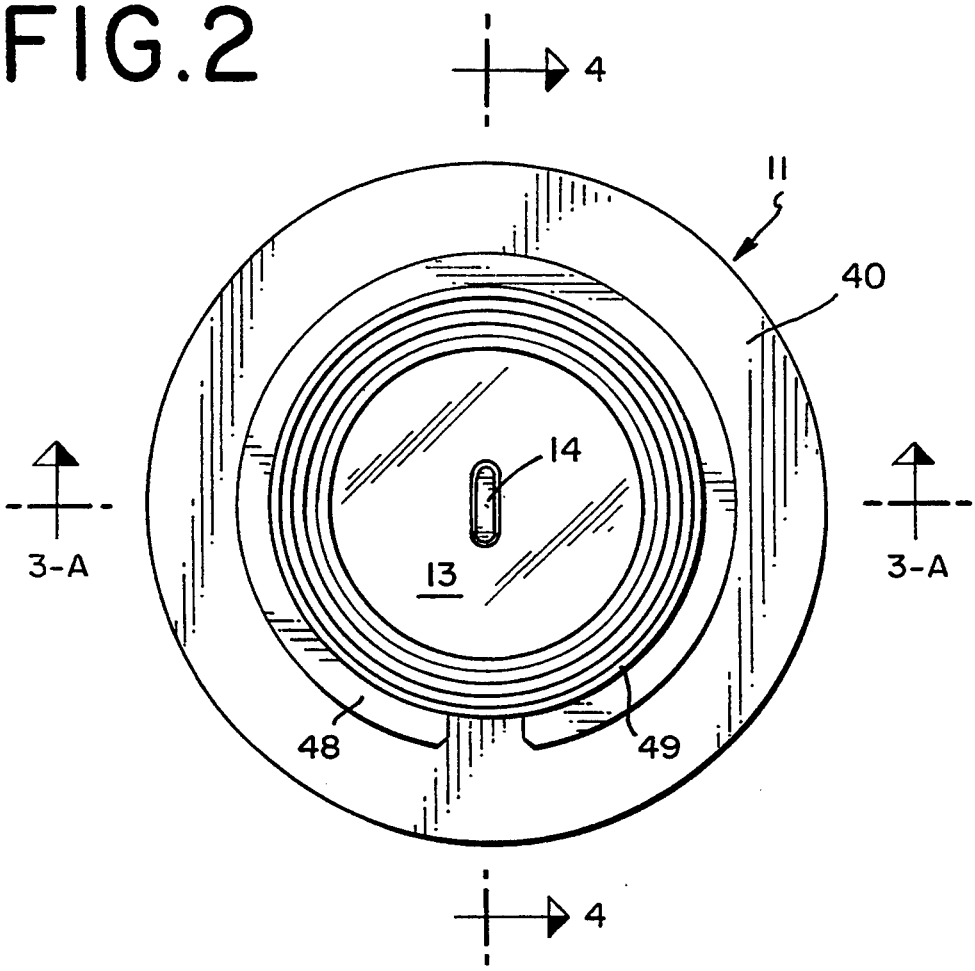
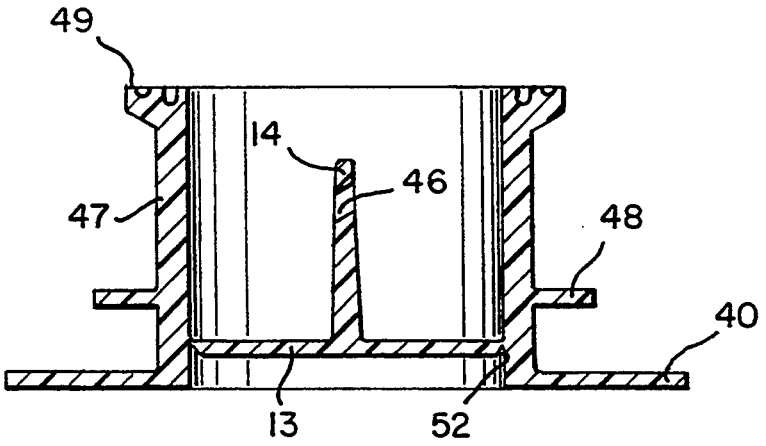
FIG.3-A

FIG.3-B
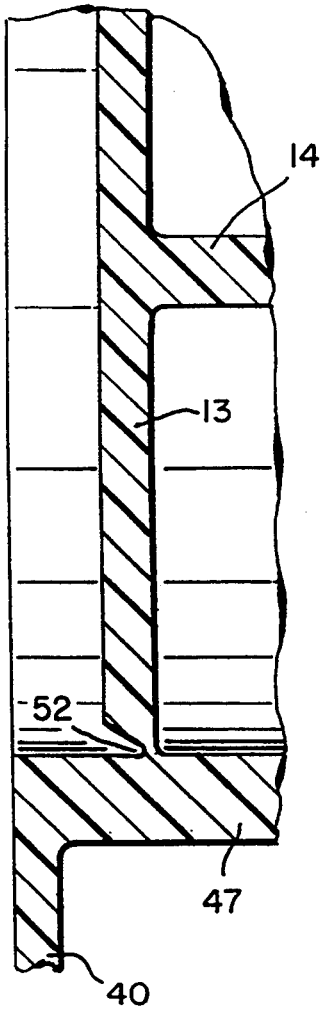
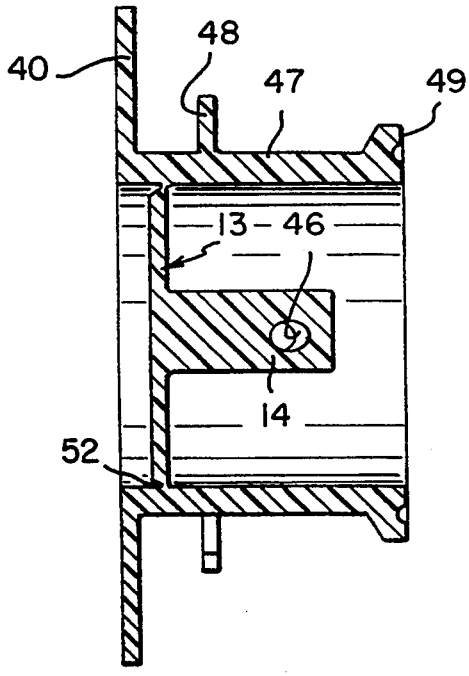
FIG.4
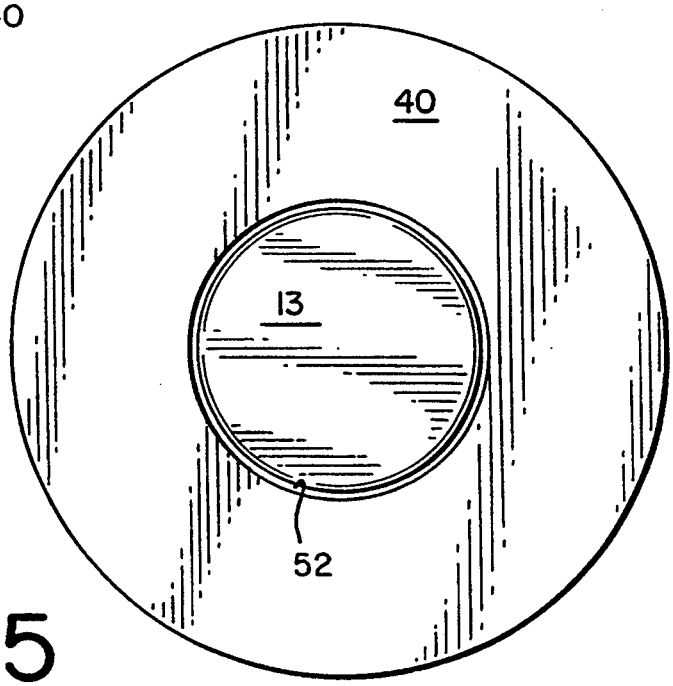
FIG.5

FIG.6
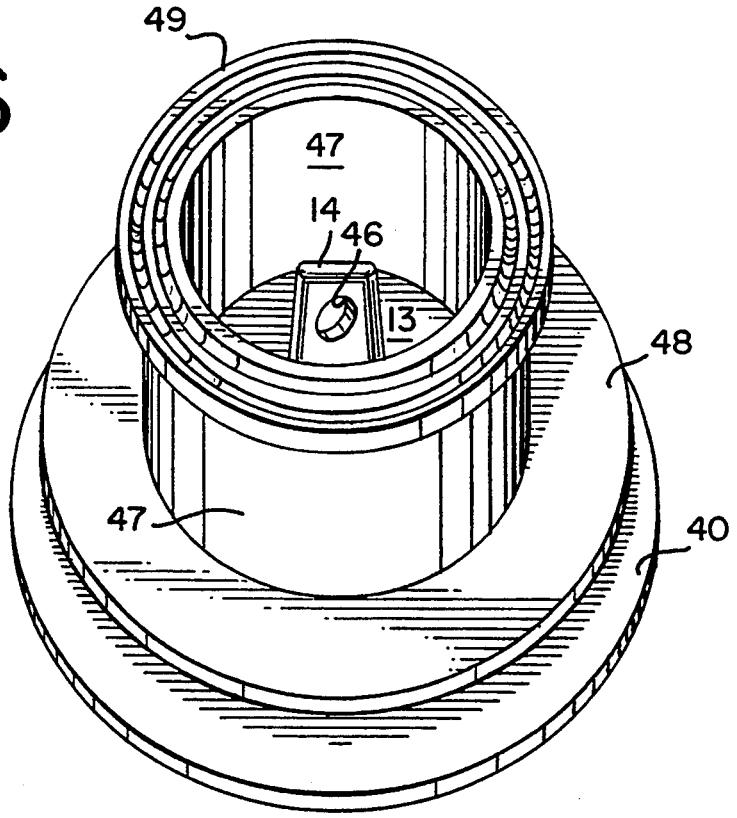
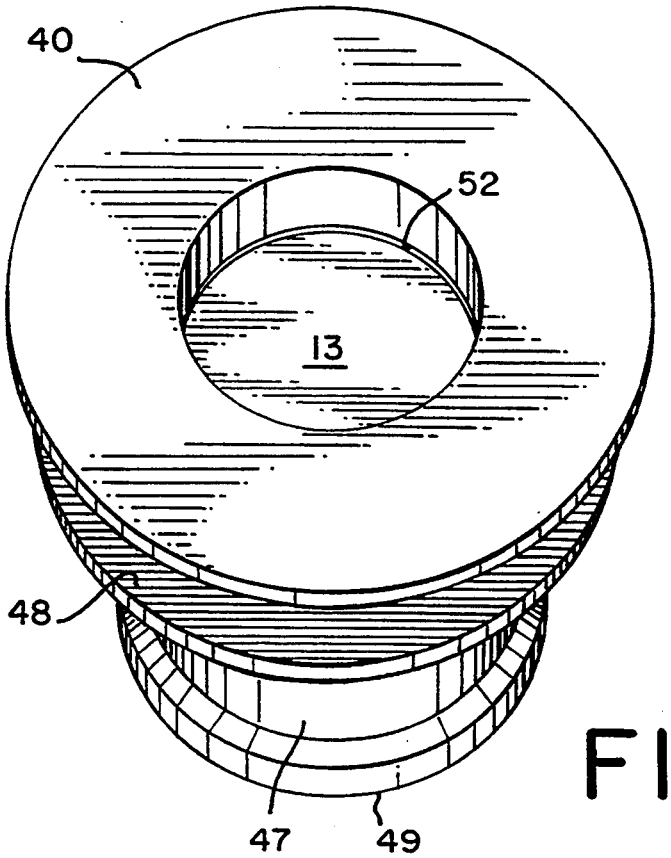
FIG.7

FITMENT APPARATUS AND METHOD TO PROVIDE BAG-IN-A-BOX SYSTEM

REFERENCE TO A RELATED APPLICATION

This is a continuation-in-part of my application Ser. No. 08/084,075 filed Jun. 30, 1993, now U.S. Pat. No. 5,373,872 the entire disclosure of which is relied on and incorporated herein by reference.

INTRODUCTION AND BACKGROUND

The present invention relates to an apparatus and method for providing a sterile "bag-in-a-box" filling and discharge system to enable the packaging, transportation, storage and utilization of fluid products such as pasteurized fruit juices and products, as well as yogurt fruit and like materials of relatively high viscosity which must be handled under aseptic conditions.

Efforts have been made in the past to develop transportable, rust free stainless steel containers, commonly known as fluid contents containers, in which the fluid materials can be directly introduced. Such containers typically are of considerable size and may amount to 25 gallons and up or, expressed in terms of liters, containers of 100 to 1000 liters. However, these stainless steel containers are quite expensive and require a series of peripheral apparatus which must be repeatedly sterilized thereby adding to the cost of such systems. The prior art is familiar with flexible bulk bags in rigid holders or bins; i.e., "bag-in-a-box" technology, especially for the containerization of various food and pharmaceutical products. Typically such items as fruit juices, yogurt fruit and the like are shipped in these boxes which consist of an aseptic bag in a rigid frame work or container. The rigid container or "box" can be made of a suitable plastic such as polyethylene, polypropylene or the like. Also, cardboard or paper board boxes can be used. The use of the so called "bag-in-box" technology is the subject of a number of prior art publications such as shown in European patent application 0190757, German patent 35 03 916, German OLS 35 34 810 and OLS 36 15 063.

At present, the filling of such aseptic bags is accomplished by utilizing expensive auxiliary filling equipment. After filling, the containers can be stored aseptically with little or no refrigeration for an extended period of time. It is customary at the present time to accomplish dispensing of the bag contents by emptying the entire contents of the bag or utilizing expensive discharge equipment to permit reentry while maintaining asepsis of the bag. Normally, the container including the bag must remain attached to the unloading device until all the required product has been discharged.

It is an object of the present invention to overcome some of the problems associated with prior art apparatus and to facilitate the loading and unloading of sterilized and aseptic containers.

In my earlier copending application there is described an apparatus containing a fitment with an openable diaphragm with a tool for tearing out the diaphragm.

It is an object of the present invention to provide further embodiments of the bag-in-box apparatus.

SUMMARY OF THE INVENTION

In achieving the above and other objects of the invention, one feature of the invention resides in a fitment device containing an openable diaphragm which is attached to the opening of a flexible bulk container, commonly called "a bag".

In my earlier copending application there was provided a device enabling the attachment of a stainless steel butterfly valve to an aseptic fitment. The fitment contains a diaphragm which is torn out of the fitment. The diaphragm is then removed.

According to a feature of the present invention there is provided a new embodiment of my previous device whereby improved results are obtained in being able to more effectively tear out and remove the diaphragm from the fitment apparatus.

Another feature of the present invention is provided by another new embodiment of my previous device whereby an aseptic bag fitment is provided without a diaphragm which eliminates the need for a tool to remove the diaphragm seal.

In general, both embodiments of the bag and fitment apparatus of the present invention to be described herein are adapted to fit within a rigid container, or "box"; hence the term of art "bag-in-a-box". The fitment is arranged to fit the rigid container at the lower wall portion of the box which is at the point of filling with the fluid contents. The fitment device facilitates maintaining the sterility and aseptic integrity of the interior of the bag. The fitment and flexible bag are connected to a valve or other suitable valve that can be used to fill the bag container with sterile contents, such as a food product. The same valve mechanism is then later used to dispense product in an aseptic system without necessarily discharging the entire contents. The flexible bulk containers or bag and the fitment device are integral parts of a nestable, aseptic bin system where the flexible bulk container, referred to herein as the "bag" is located in a bin or rigid framework (box) which permits the reuse of the bin and valve apparatus and the disposal or recycle of the used bag and fitment.

According to the first new embodiment of the invention the fitment mechanism that is provided has a diaphragm seal and at one end is fitted to a re-usable stainless steel fill and discharge valve. As with embodiments in my earlier application, the fitment device is fitted to the bag to provide for maintaining asepsis with respect to the interior of the bag. The sealed bag and fitment device presterilized by irradiation and then fitted to the clean but not necessarily sterile rigid bins, is then fitted with a valve mechanism or similar valve. Steam sterilization can take place at that point. The diaphragm seal that is an integral part of the fitment device is then removed through the valve by a special diaphragm opening device.

According to this new embodiment of the invention, there is provided a novel diaphragm opening tool which acts to first break the diaphragm with a strike plate and mallet type tool. The dislodged diaphragm is then removed by an attached linkage such as a chain which permits retrieval and withdrawal.

The valve attached to the bag can now be closed and the diaphragm opening tool removed. The sterile bag-in-box system can be relocated and attached to a filling apparatus capable of supplying sterile product. Interconnections between the bag-in-box and filling apparatus are sterilized prior to opening the bag-in-box valve and filling. The valve is then shut and the bag-in-box container is removed from the filling apparatus for storage or shipment.

In the second embodiment of this invention there is provided a fitment that is open and has no diaphragm to remove. The open version of the fitment is heat sealed to a flexible bag liner in the same manner as the aseptic fitment. The butterfly valve, typical of those used in the bag-in-a-box, is attached to the open fitment. No aseptic diaphragm seal removing tool is required since there is no seal to remove.

The present invention provides a departure from previous designs because it enables the filling of empty sterile bags without the need for auxiliary filling equipment. The aseptic fitment device of the present invention permits the dispensing of any desired amount of product while maintaining asepsis of the package and contents. No auxiliary equipment for discharge is required. The fitment of the present invention permits the user to convert from the very expensive stainless steel tote shipping containers currently in use in the industry to far less expensive stackable, reusable plastic bins with aseptic bag liners.

BRIEF DESCRIPTION OF THE DRAWINGS

The invention will be further understood from the accompanying drawings, wherein:

FIG. 2 is a frontal elevational view of one embodiment of the fitment device containing the diaphragm of the present invention;

FIG. 3A is a sectional elevation view of the fitment device along the section line 3A—3A of FIG. 2;

FIG. 3B is a cross sectional view of the details of the diaphragm and its attachment to a fitment device of the invention;

FIG. 4 is a sectional elevation view taken along the line 4—4 in FIG. 2 showing a fitment of the invention;

FIG. 5 is a rearward elevational view of a fitment device of the present invention;

FIG. 6 is a perspective view of the front of a fitment device according to the present invention;

FIG. 7 is a perspective view of the rearward side of a fitment device of the present invention;

DETAILED DESCRIPTION OF THE INVENTION

Figure 1:
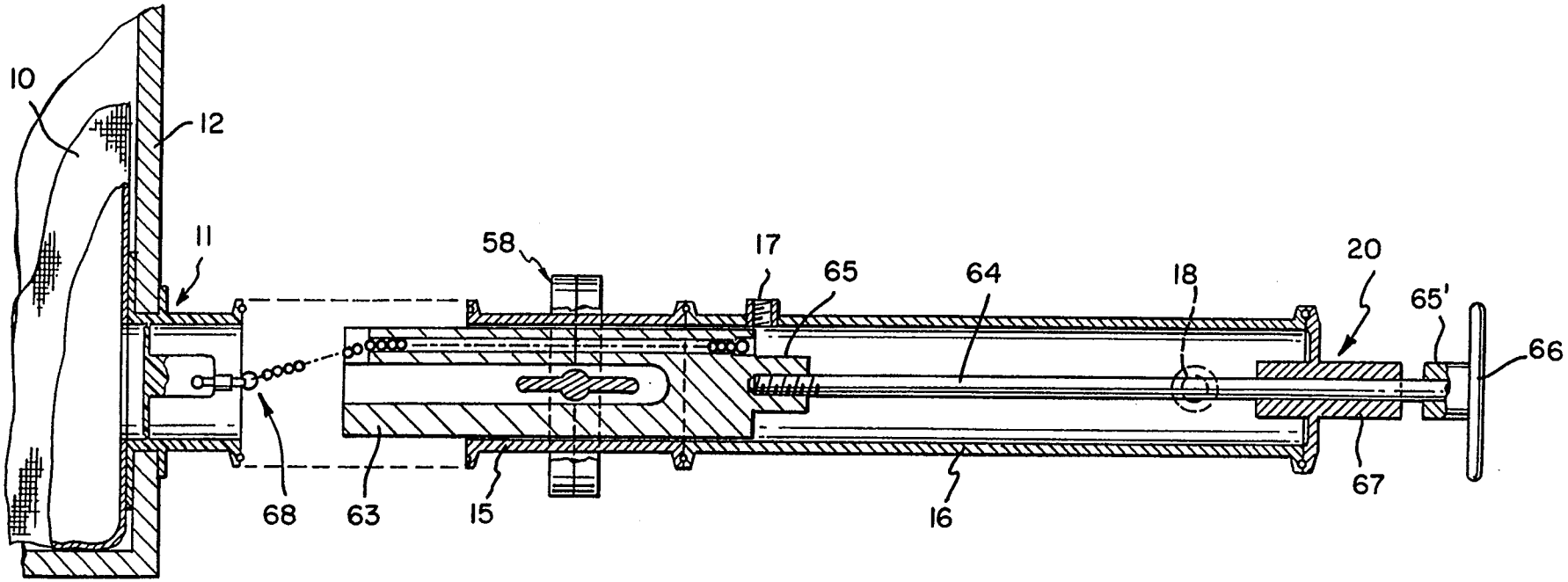
FIG. 1 is an exploded sectional elevation view of one embodiment of the apparatus of the present invention.

As shown in FIG. 1, the present invention relates to the method and apparatus for fitting an aseptic collapsible bag 10 into a rigid container 12 and the filling of the bag with a sterilized product such as food or pharmaceutical under conditions of asepsis. Pursuant thereto, the present invention provides a tubular fitment device 11 located at or near the bottom of a rigid container 12. The fitment includes a diaphragm 13 having an attached pull tab 14 or other removal means. Arranged to be clamped or otherwise removably attached to the fitment 11 is a valve 58 located in a tubular pipe section 15 adapted for conventional connection to a second tubular section 16, called a steam spool, which is equipped with ports 17 and 18 for the introduction of steam and the exiting of steam condensate, respectively. The steam spool is necessary for purposes of sterilization of the apparatus. An impact and removal tool 20 is provided which is adapted to be attached to the pull tab 14.

Tubular sections 15 and 16 contains therein butterfly valve 58 and the impact/removal tool formed of a stainless steel spool 63 having a wide valve notch, screw collar 65 welded to spool 63 end and the strike plate. The other end has a set screw collar 65' fitted to the strike plate 66. A long stainless steel rod 64 is fitted into screw collars 65, 67 and 65'. The tubular section 16 is equipped with steam inlet 17 and outlet 18 ports. A long rod 64 connects the spool end 63 with strike plate 66. A standard chain or other linkage 68 connects the impact tool with the fitment 11.

One embodiment of the fitment 11 of the invention having the diaphragm is shown in more detail in FIG. 2. The fitment can be located near the bottom portion of a suitable rigid container or bin 12 formed of paperboard or rigid plastic such as polypropylene or the like as shown in FIG. 1. The collapsible bag 10 is arranged within bin 12. An opening in bag 10 is aligned with the flange portion 40 of the fitment which fits inside of the opening in bin 12. The bag area near the opening is adhered to the flange 40 to secure the bag to the fitment. In this view shown in FIG. 2, the frontal side of the fitment 11 is depicted. A large circumferential flange 40 surrounds the fitment. Tab 14 is located for example at the center of diaphragm 13 but can also be located off center. The tab 14 can be replaced by ring means or any other suitable removal means.

As shown in FIG. 3A the throat section 47 of the fitment 11 extends outside of the bin 12 (not shown) and is adapted to be clamped or otherwise removably connected to an adjacent tubular member by suitable means such as a small flange end 49. Within the throat portion 47 of the fitment there is located diaphragm 13.

Generally the diaphragm 13 is situated in the opening of the fitment nearest the bag 10; that is, on the inner most side of the fitment. The diaphragm is constructed so as to be removable when impacted by the impact/removal tool and pulled in the direction away from the bag opening. Score lines are provided on the diaphragm for this purpose. The diaphragm can be formed of any acceptable polymer, such as high density polyethylene, or other suitable material, and is fitted with a pull ring or tab 14. Hole or slot 46 is provided for attachment to a chain or removal device. Portions of the throat section 47 of the fitment 11 may be reinforced with additional plastic material for added strength. Because the fitment is subjected to steam for purposes of sterilization, it is necessary that the fitment be made of a temperature resistant polymer, such as high density polyethylene or other high temperature resistant polymer as will be apparent to those skilled in the art. However, the section of the fitment which is not necessarily subjected to steam, such as the flange 40 which is adhered to the bag material can be made of a material which has less resistance to temperature and is therefore less costly, such as a low density polyethylene or other less costly suitable material. The pull ring or tab 14 can also be formed of a somewhat flexible polymeric material such as polyethylene or the like. The fitment throat section 47 and connecting flange end 49 can be conveniently formed of an HDPE (high density polyethylene) or the like and molded to the shape of any common sanitary connection as shown in FIG. 1. HDPE (high density polyethylene) or other suitable material can be used to form the diaphragm 13 that is adapted to be removed as well as the bag mounting flange 40. HDPE or other strong and more temperature resistant material is desired for connection to the stainless steel valve typically used in the industry for filling purposes and also to withstand heat conduction during the sterilization operations.

The flange portion 40 of the fitment permits ease of heat sealing to the bag which is frequently made of low density polyethylene. After fabrication of the components of the fitment; i.e., the throat and the flange sections, the parts are welded or bonded together to form the composite fitment. It is of course possible to fabricate the entire fitment of the same polymeric material. When viewed from the front facing away from the bin container, the fitment of the invention is seen to be generally circular in shape; see FIG. 2. In this embodiment, the pull tab 14 is shown centrally located on the diaphragm 13.

A cross-sectional elevation view along lines 3—3 (FIG. 2) of the fitment according to an embodiment of the present invention is shown in FIG. 3A. In this view, the pull tab 14 has a removal means 46 formed therein for attachment of the opening means which is attached to the impact tool (not shown). The removable diaphragm 13 is off-set within the throat 47 a convenient distance, for example ¼ to ½ inches to facilitate hooking up with the removal tool. In this embodiment, in addition to the flange 40 for welding to the bag (not shown), a secondary flange 48 is provided which remains outside the bin and prevents the fitment from falling into the bin when the bag is empty and when the fitment is not connected to the valve.

End flange 49 is for removable attachment by conventional means to the valve (not shown).

FIG. 3B shows details of tab 14 where it attaches to the diaphragm 13. Score line 52 on the back reverse side of diaphragm 13 enable the removal of the diaphragm by breaking away from the wall of the fitment 11.

FIG. 4 is a cross-sectional view along the section line 4—4 (FIG. 2) of the fitment showing the tab 14, which when impacted by the removal tool enables the retrieval and removal of the diaphragm 13. Hole 46 in the tab is for attachment to the removal snaring tool (not shown) by a chain or similar means for removing the diaphragm 13 after it is struck by the removal tool. Removal of the diaphragm then enables filling the contents of the bag after all of the component parts are assembled.

The rear view of the fitment is shown in FIG. 5 and reveals the score line 52 which facilitates breakage when struck by the tool and pulled to open and remove the diaphragm from the throat of the fitment. Therefore, after striking and breaking out the diaphragm the pull tab 14 is pulled, and the diaphragm is removed. The circumferential score line 52 located at the perimeter of the diaphragm is broken by the initial impacting forces of the removal tool.

FIG. 6 is a perspective view and shows a fitment of the present invention with the extending end flange member 49, throat section 47 and the diaphragm 13 with pull tab 14. Secondary flange 48 secures the fitment to the bin (not shown).

The rear view of the fitment of the invention is shown in FIG. 7 with the large flange 40 for heat sealing to the bag (not shown) and the diaphragm 13. The score line on the rear surface of the removable diaphragm are clearly indicated.

A variety of sanitary or aseptic valves commonly known in the art can be used for purposes of this invention. These can be manual or air operated. Examples of such valves are sold by GH Products Corp. of the Alfa-Laval Group. Persons skilled in the art will be able to select a suitable valve to match the purpose intended.

Figure 8:
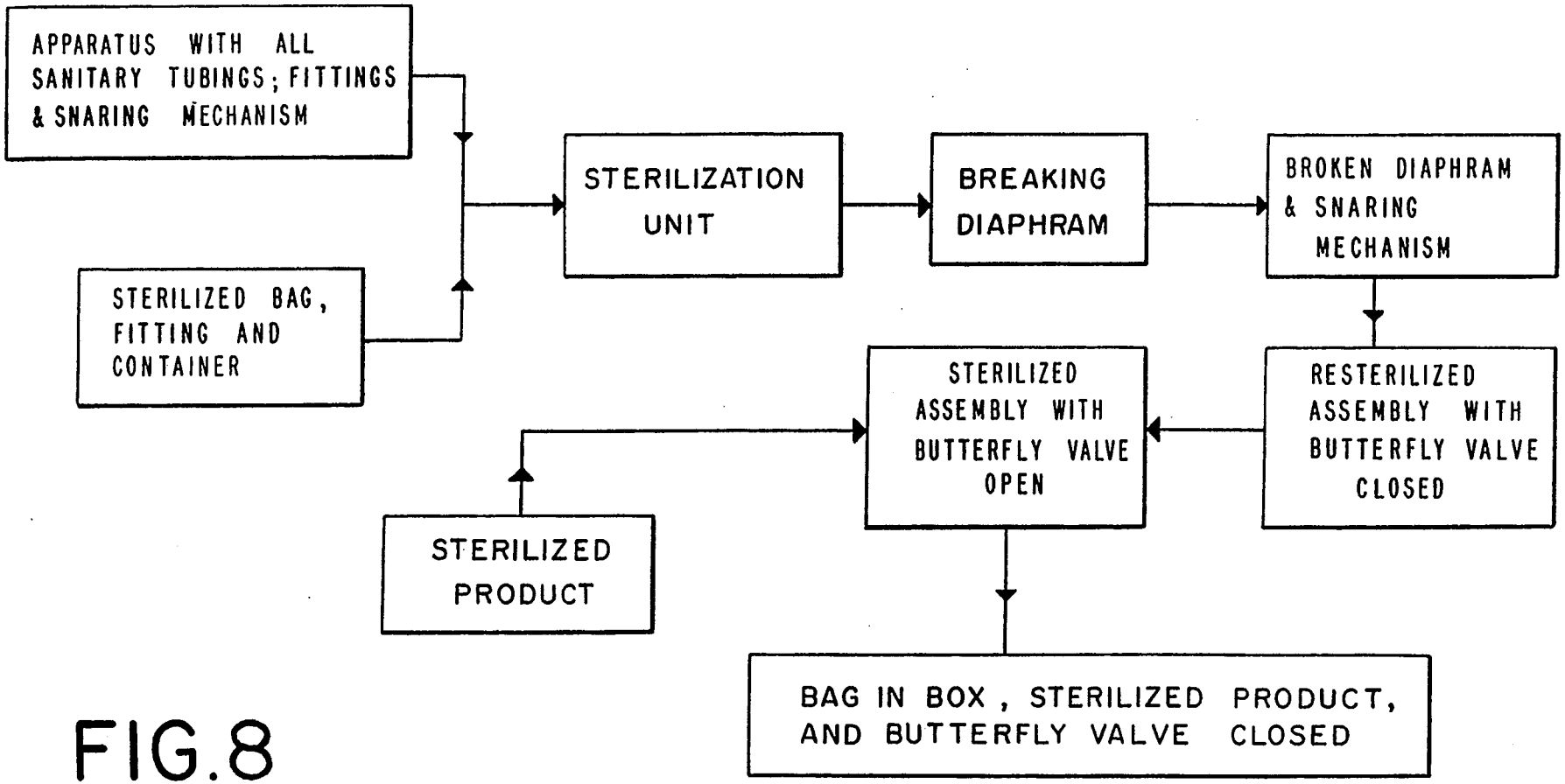
FIG. 8 is a flow diagram of one embodiment of the process of the present invention.

In carrying out the method of assembly of the apparatus of the invention there is shown in FIG. 8 the flow sequence whereby the bag-in-the-box with new fitment with diaphragm arrangement is prepared. In a first step, the fitment device, connected to the sterile empty flexible bag 10, is positioned in the rigid container 12. The diaphragm on the fitment bag acts as a seal for the bag and thereby maintains asepsis within the bag.

The empty bag and box with the fitment connected is then, in turn, connected to the valve and the steam spool and striking/snaring tool. The free end of the striking/snaring tool which can be a simple hook or chain device is then hooked into the hole of the pull tab. The apparatus thus connected is then subjected to a steam sterilization by operating the steam spool. The inlet port is opened and the steam is introduced throughout the system of fitment and valve. Condensate exits through the condensate port. After a suitable time sufficient to achieve sterile conditions, the steam inlet and condensate port is closed.

Thereafter the striking/snaring tool is operated to first impact the diaphragm by moving the striking tool inwardly to rupture the periphery of the diaphragm. Then the tool is moved outwardly to pull the tab and remove the diaphragm thereby removing the seal between the bag 10 and the remainder of the apparatus. The valve is then closed.

The striking/snaring device and the torn out diaphragm are then removed and the equipment is resterilized with the valve closed. The sterilized bag-in-box is then subjected to the filling operation with the sterilized products such as particulate fruit or fruit puree. The valve is then shut and the entire apparatus is removed from the filler apparatus for shipping or storage.

The operation of the striking/snaring mechanism is shown in the embodiment of FIG. 1 which shows a simple push-pull handle 66 in a sanitary tube where the handle is connected through rod 64 to the tab 14 of the diaphragm for opening and closing the bag-in-the-box.

The handle embodiment of FIG. 1 includes strike plate 66 attached to rod 64 which in turn is attached to a chain 68 passing through valve 58 and is connected to the tab 14. The striker mechanism, for example, is formed of a 2 inch diameter by 7.125 inch stainless steel spool 63 with a 5.75 inch long and 0.75 inch wide valve notch. Dimensions can, of course, be varied. The notch allows the striker spool to move around the valve and move inwardly to strike and break out the diaphragm.

Figure 9:
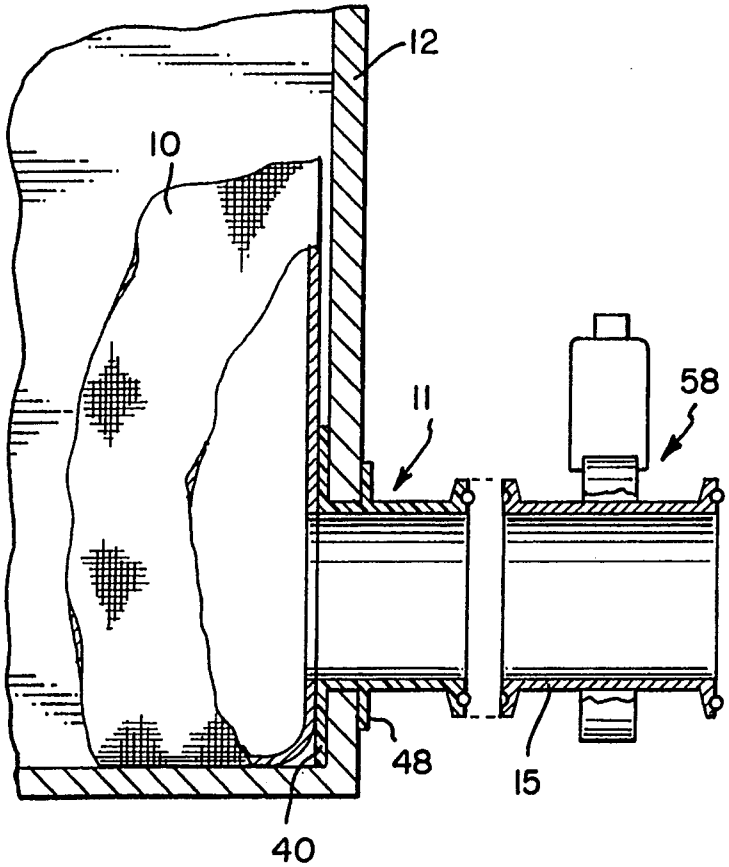
FIG. 9 is a cross sectional elevation view of another embodiment of the apparatus according to the invention showing a fitment without a diaphragm.

In FIG. 9 there is shown a schematic cross-section of a further embodiment of the present invention wherein fitment 11 is not equipped with a diaphragm thereby also eliminating the need for a removal tool.

Figure 10:
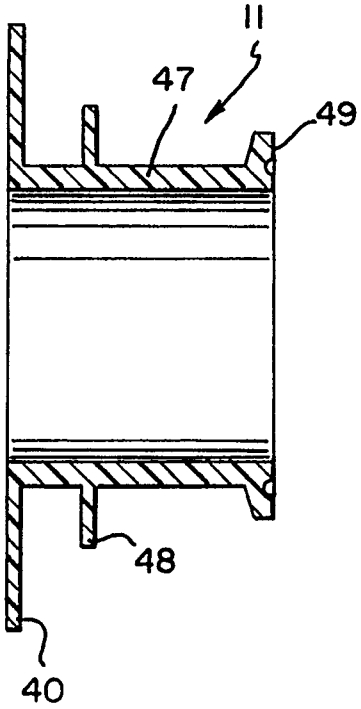
FIG. 10 is a cross sectional view of another embodiment of the fitment of the present invention which is free of a diaphragm.

FIG. 10 shows a sectional view of the embodiment of the fitment without the diaphragm.

The open version of the aseptic fitment as shown in FIGS. 9 and 10 does not contain the diaphragm seal. The fitment is heat sealed to a flexible bag liner as is the case with the other embodiments of the invention. The butterfly valve, used on the aseptic application, is attached to the open fitment. The aseptic diaphragm seal removing tool is not required for this application since there is no seal to remove. The bag in bin package, with stainless steel valve attached can be used in any application requiring liquid storage within a portable tote bin. Compatibility of the stored liquid and the liner is the only criteria. The package is particularly suited for sanitary applications, such as the food or beverage industry because of the sanitary components of the package.

The present invention can be carried out in many ways and an example of the method of the invention is described in further detail herein below.

The fitment 11 is welded onto the bag 10 and this combination is then sterilized. Typically the bags can be irradiated to sterilize the inside thereof. Once the sterilization is completed, then everything to the left of the fitment 11 shown in FIG. 1 is sterilized. The bag is fitted into the bin in a collapsed state so that it can be properly set in the bottom of the rigid container 12 in such a way that it will not fall out or fall inside the bin. Conveniently, at this point, the valve unit 58 which is attached to the tubular pipe section 15 is then connected by conventional means to the steam/removal device 16. The units are assembled such that the removal tool extends into the tubular sections 15 and 16 and through a suitable opening in valve 58. All components are then clamped and connected in place. The removal tool extends into the fitment 11 and the operator would attach the end of the removal tool to tab 14. After that, the fitment is clamped or bolted or otherwise connected by conventional means to unit 15, After connection of all tubular members, the steam source is hooked up to steam entrance port 17 and steam is turned on to sterilize the entire chamber including the fitment, the tubular member 15, the removal tool and the tubular member 16. Condensate is drained from exit port 18. After a suitable period of time sufficient to achieve sterilization, the steam and condensate is turned off and the removal tool is pushed inwardly to break the score line surrounding the diaphragm and then is pulled outwardly to pull the diaphragm completely through the valve and the steam spool section. Since the diaphragm is made of flexible material, it can be readily pulled through the apparatus for removal. This operation then opens the bag 10 to the fitment device and the valve which is then shut to close the bag opening. At this point, steam spool 6 can be disconnected from member 15. The combination of the bin 12, bag 10 and closed valve 58 is thereby rendered aseptic. This combination can then be shipped to any location for mounting on a pipe and connected to another steam spool so that the other side of the pipe is then steamed to sterilize the chamber. The valve can then be opened to fill the contents of the bag with the sterile product. Thus the steam spool can be resterilized and also the product valve can be sterilized.

In carrying out the method of the invention using a fitment without the diaphragm, the above steps are followed without, of course, the steps involving manipulation of the removal tool.

Further variations and modifications of the foregoing invention will be apparent to those skilled in the art and are intended to be encompassed by the claims appended hereto.

I claim:

1. An apparatus for the packaging of a fluid, optionally sterilized, product comprising a fitment having a throat section, a flange located at a first end of said throat section, and provided with a diaphragm section removably attached in said throat section and proximate said first end, said diaphragm being fitted with a tab member as removal means, the diaphragm being provided with score lines permitting said tab member to be separated from said throat section for controllably cutting said diaphragm along said score lines thereby enabling said diaphragm to be removed from said throat section, said throat section terminating at a second end in a second flange member, said second flange member being removably attached to valve means, said valve means being attached to a steam spool section, snaring means being attached to said steam spool section, said snaring means comprising a handle, a flexible member removably connected to said removal means in said throat section and a striking means to break out said diaphragm, the opposite end of said flexible member being attached to said handle of said snaring means, said handle being movable so as enable separation of said diaphragm from said throat member and being of capable of removing said diaphragm from said throat section of said fitment.

2. The apparatus of claim 1 wherein said throat section has attached thereto third flange member means which is adapted to accommodate a wall section of a rigid container means.

3. The apparatus of claim 1 further comprising rigid container means adapted to have said fitment means pass through an opening in said container means so as to enable said throat section to be passed through said opening to enable attachment to said valve means.

4. The apparatus of claim 1 wherein said handle means moves inwardly so as to impact the diaphragm and break it away from said throat section and moves outwardly so as to pull said tab member to remove the diaphragm.

5. The apparatus of claim 1 wherein said handle means is attached to spool means and moves in one direction so as to strike out the diaphragm and then moves in the opposite direction to pull out the diaphragm by means of a flexible connector attached to said diaphragm.

6. An article comprising a flexible bag member combined with and connected to the apparatus of claim 1.

7. The article of claim 6 which further contains a liquid or fluid food product under sterile conditions in said bag member.

8. The method of equipping a flexible bag member with fitment means to enable filling of said bag with a product, optionally under sterilized conditions, comprising assembling rigid container means and flexible bag member means having a opening by welding fitment means onto said opening of said bag member at flange means attached to said fitment means, attaching valve means to said fitment means, attaching snaring means to diaphragm means, removing said diaphragm means and resterilizing said bag against the said valve in a closed position to obtain a sterilized bag, introducing into said sterilized bag said product through the valve, shutting the valve and removing the container from the filling apparatus.

9. A method for providing an optionally sterilized bag in box container comprising providing a flexible bag made of flexible polymeric film and welding said bag onto tubular fitment means such that an opening in said bag is aligned with said fitment means, fitting the bag and fitment means into a rigid container therefor, connecting said fitment means to valve means through removable attachment means, attaching said valve means in a removable manner to steam spool means, attaching separation means to said steam spool means and passing the separation means through said steam spool means and said valve means into said fitment means and attaching said separation means to removal means located on diaphragm means in said fitment means, introducing steam into said steam spool means, to sterilize said fitment means, discontinuing the steaming and operating the separation means so as to separate the diaphragm means along score lines and to thereby remove the entire diaphragm means from said fitment means and to provide a connection between said bag and said valve means, thereafter closing said valve means and removing said separation means, introducing steam in said steam spool means to sterilize the opening side of said valve means, attaching said valve means to a filler apparatus in fluid communication with a source of sterilized product, opening said valve means and introducing sterilized product into the bag box, thereafter when said bag is filled with said sterilized product, closing said valve means and removing said container from said filler apparatus.

10. The method according to claim 9 wherein said separation means is a snaring device which pulls on said removal means to tear out the diaphragm.

11. The method according to claim 9 wherein said separation means includes a striker plate that impacts said diaphragm means to separate the diaphragm from said fitment.

* * * * *